United States Patent [19]

Desio

[11] 4,002,872

[45] Jan. 11, 1977

[54] ELECTRICAL SWITCH HOUSING DETACHABLY MOUNTABLE ON A GAS VALVE STRUCTURE

[75] Inventor: Frank B. Desio, Melrose Park, Ill.

[73] Assignee: Illinois Tool Works Inc., Chicago, Ill.

[22] Filed: June 18, 1975

[21] Appl. No.: 588,126

[52] U.S. Cl. ..... 200/294; 200/61.86; 200/293

[51] Int. Cl.[2] ..... H01H 9/02

[58] Field of Search ..... 200/61.86, 293, 294, 200/295, 296, 307; 251/291, 293; 137/802, 798

[56] References Cited

UNITED STATES PATENTS

| | | | |
|---|---|---|---|
| 2,928,998 | 3/1960 | Brumfield | 200/293 X |
| 3,215,805 | 11/1965 | Wilson et al. | 200/293 X |
| 3,502,835 | 3/1970 | Batcheller | 200/61.86 |

*Primary Examiner*—James R. Scott
*Attorney, Agent, or Firm*—Glenn W. Bowen; Robert W. Beart

[57] ABSTRACT

An electrical switch housing which may be mounted on the control shaft of a gas valve of a household gas appliance in order to control an ignition circuit which ignites the gas that is controlled by the valve is provided. The electrical switch housing has a central aperture which holds a rotatable operating member that has an aperture in it which receives the control shaft of the valve. The switch housing may have two, three or four mounting posts which extend normal to it and are positioned relative to one another so that they prevent the housing of the switch from rotating when the control shaft is rotated.

6 Claims, 21 Drawing Figures

Fig. 1
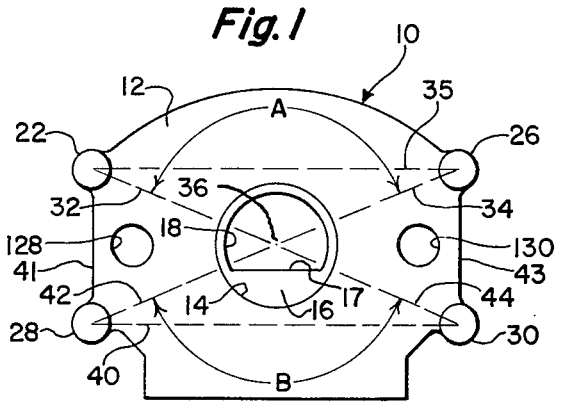
Fig. 2
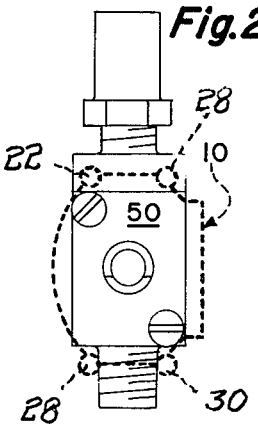
Fig. 3
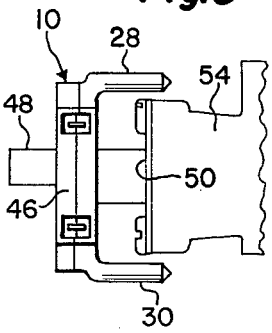
Fig. 4
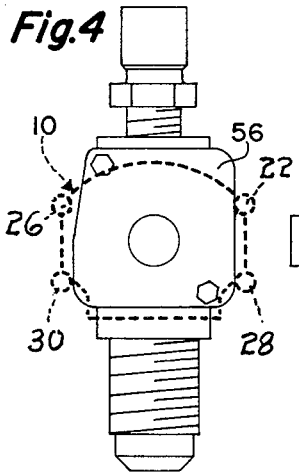
Fig. 5
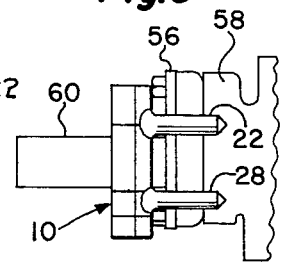
Fig. 6
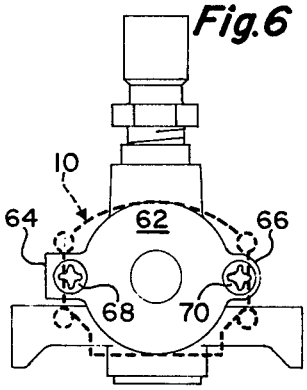
Fig. 7
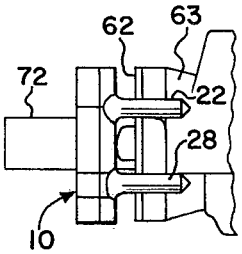
Fig. 8
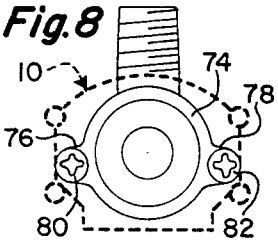
Fig. 9
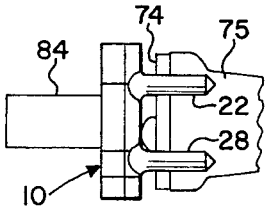
Fig. 10
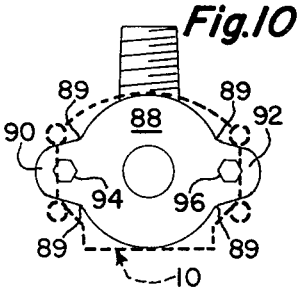
Fig. 11
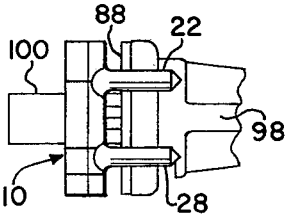
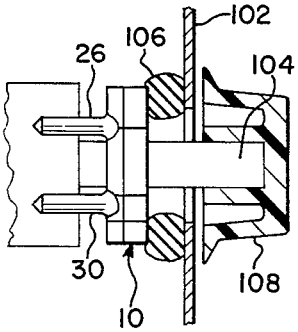
Fig. 12
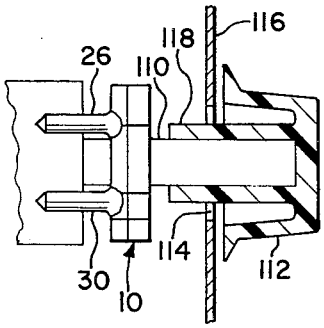
Fig. 13
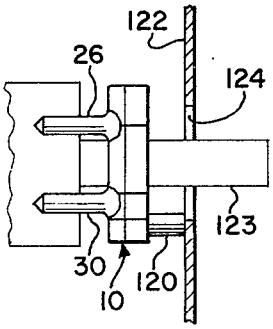
Fig. 14

ELECTRICAL SWITCH HOUSING DETACHABLY MOUNTABLE ON A GAS VALVE STRUCTURE

BACKGROUND OF THE INVENTION

An ever-increasing demand is being placed on the natural resources of the world, and it is now apparent that conservation of natural resources must be practiced whenever possible. Natural and man-made gases which are piped to residences and businesses for heating and cooking are included in the precious resources that must be preserved for the future. At the present time the ignition of gas in household appliances is achieved chiefly by a continuously burning pilot flame. While the gas that is consumed by any given pilot flame is small, the total amount of the gas that is consumed by all of the pilot flames in all of the appliances in a country or in the world is a large and unnecessary use of our precious gas resources.

In order to eliminate the burning of gas for pilot flames, it is necessary merely to provide an electrical ignition circuit which is synchronized with the opening of the valve so that the gas can be ignited by a spark or an arc. However, the major appliance and valve manufacturers who make gas valves have perfected the design of their valves over a period of years. The design of new gas valves could be undertaken to comply with the necessity of mounting an electrical switch on them for electrical ignition, but this would probably increase the price of the appliance to the customer and would likely delay the introduction of such devices. On the other hand, the electrical switch manufacturers could certainly provide a separate electrical switch housing for each type of gas valve that is manufactured. Again, the cost to the consumer would likely be increased. Moreover, it is desirable to be able to convert valves in existing applications to electrical ignition without requiring modification of the valve already being used.

The leading types of gas valves for gas household appliances are all of the same general size, but they are manufactured in a variety of shapes and they each have a different front panel. Logically, then, it would be expected that each of the gas valves would require a different type of mounting means to mount an electrical switch on it. The present invention, however, provides a mounting means for an electrical switch which allows the same electrical switch to be inserted on the five types of gas valves which constitute the vast majority of the valves that are currently used on gas appliances in the United States. It is estimated the switch of the present invention will be mountable on from 70% to 80% of the gas valves that are now in use in the United States without modification of the valve or the switch housing except for a very slight modification of the front plate of one of these types of valves.

DESCRIPTION OF THE DRAWINGS

The present invention is described by reference to the drawings in which:

FIG. 1 is a plan view showing one version of the electrical switch and mounting means of the present invention;

FIG. 2 is a front view of a Roberts Brass gas valve with the switch of FIG. 1 being shown on the valve by a dotted line representation;

FIG. 3 is a side view showing the switch of FIG. 1 and a portion of the valve of FIG. 2;

FIG. 4 is a front view showing one type of a Harper Wyman gas valve with the electrical switch of FIG. 2 being shown by a dotted line representation;

FIG. 5 is a side view of the electrical switch of FIG. 1 and a portion of the valve of FIG. 4;

FIG. 6 is a front view of a Robert Shaw gas valve with the electrical switch of FIG. 1 being shown by a dotted line representation;

FIG. 7 is a side view showing the switch of FIG. 1 and a portion of the valve of FIG. 6;

FIG. 8 is a front view of a Schoenberger gas valve which shows the electrical switch of FIG. 1 by a dotted line representation;

FIG. 9 is a side view which shows the electrical switch of FIG. 1 and a portion of the valve of FIG. 8;

FIG. 10 is a front view which shows a second type of Harper Wyman gas valve with the electrical switch of FIG. 1 being shown by a dotted line representation;

FIG. 11 is a side view of the switch of FIG. 2 and a portion of the valve of FIG. 10;

FIG. 12 is a side cross-sectional view which shows the electrical switch of FIG. 2 mounted adjacent a panel with a retention washer on the control shaft of the valve to limit the movement of the switch along the shaft;

FIG. 13 is a cross-sectional view showing the electrical switch of FIG. 1 mounted on a gas valve with a knob on the control shaft of the valve which limits the motion of the switch along the shaft;

FIG. 14 is a cross-sectional view of the electrical switch of FIG. 1 which is mounted on a gas valve adjacent a panel which has a mounting post that extends adjacent the panel to limit the movement of the switch along the shaft;

TECHNICAL DESCRIPTION OF THE INVENTION

Figure 15:
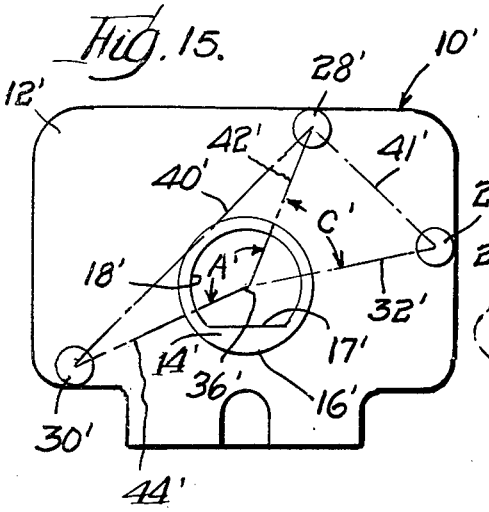
FIG. 15 is a plan view showing a second version of the electrical switch and mounting means of the present invention.

The electrical switch of the present invention is constructed to be mounted on a variety of gas valves for household gas appliances in order to control an ignition circuit which is operated in conjunction with the rotation of the shaft of the gas valves. The version of the electrical switch 10 of the present invention shown in FIGS. 1–14 consists of a housing 12 which has a central aperture in it 14 into which a rotatable operating member 16 is inserted. The rotatable operating member 16 has a central aperture 18 and a flat surface 17 on it which imparts a "D" shape to the aperture 18. The shape of the aperture corresponds to the shape of the valve shaft which fits through the aperture 18.

When the shaft of the gas valve is rotated the operating member 16 rotates and operates the contacts (not shown) of the switch 10. The particular type of switch that is employed is not of consequence in the present application. It may, for example, be the type disclosed in U.S.. Pat. application Ser. No. 517,270 filed Oct. 23, 1974 in the name of William E. Ward, entitled, "Gas Ignition Switch" and assigned to the assignee of the present invention. An ignition circuit which may utilize the switch to ignite the gas from the gas valve is also disclosed in the Ward application. The Ward application is thus hereby incorporated by reference herein. The swtich could also be of the type disclosed in the Batcheller U.S. Pat. No. 3,502,835.

The gas ignition switch of the present invention requires that the housing 12 remain stationary relative to the gas valve when the operating member 16 is rotated, both in the clockwise and the counter-clockwise directions. In order to accomplish this, the housing 12 may have four posts 22, 26, 28 and 30, which preferably are molded into the housing member 12, that extend outwardly at substantially a right angle with respect to the housing 12. It has been determined that the four posts 22–30 will hold the housing 12 against relative rotation, with respect to several of the most popular gas valves in use in household appliances in the United States, when the operating member 16 is rotated. The posts 22 and 26 are positioned so that the angle A between the radial lines 32 and 34 which run from the center 36 of the aperture 18 and which pass approximately through the centers of the posts 22 and 26, respectively, are positioned so that the angle A equals approximately 135°; and so that the distance of the chordal length between the posts 22 and 26 along the line 35' is approximately one and one-quarter inches. A second pair of posts 28, 30 are also preferably employed in which the chordal length 40 is also approximately equal to the chordal length 35 and the angle B between the radial lines 42 and 44 is also approximately equal to 135°. The posts 22–30 each have a length which is preferably several times longer than the width of the switch housing across the side 46 of the housing 12, as shown in FIG. 3. The posts 22–30 are aligned so they form the corners of an imaginary rectangle with the sides 35, 40, 41 and 43. The distance between the post 22 and the post 28 and the post 26 and the post 30 is approximately one-half inch along the sides 41 and 43 of the housing 12, and the posts 22, 26 are substantially equidistant along the radial lines 32 and 34 from the center 36 while the posts 28, 30 are substantially equidistant from the center 36 along the radial lines 42 and 44.

FIGS. 2 through 11 represent the front and side view of the switch 10 of the present invention when it is positioned on the various gas valves that make up the majority of valves currently used on household appliances in the United States. FIG. 2 shows a Robert Brass gas valve with the switch 10 being shown by a dotted line representation, which represents its position relative to the control shaft 48, the substantially rectangular front plate 50 and the forward projecting portion 54 of the Robert Brass valve. The posts 22–30 engage the front plate or panel 50 of the portion 54 of the Roberts gas valve, or both, in the manner shown in FIGS. 2 and 3, so that rotation of the shaft 48 does not allow rotation of the housing 12 because the posts 22–30 prevent the housing 12 from turning.

The switch 10 of the present invention is shown in FIG. 4 on one type of a Harper Wyman valve in which the front plate 56 is of a non-uniform shape. Again, the posts 22–30 interact with the front plate 56 or the forward portion 58 of the valve, or both, to prevent the switch housing 12 from turning when the control shaft 60 is rotated.

FIG. 6 shows a Robert Shaw type of valve, in which the front plate 62 is of a generally circular shape which has two projecting end portions 64 and 66 which receive mounting screws 68 and 70 therein. Again, the posts 22–30 interact with the front plate 62 of the forward portion 63 of the valve, or both, to prevent the switch end from rotating when the shaft 72 is rotated.

FIG. 8 shows a Schoenberger type of valve which has a generally circularly-shaped front plate 74 and a pair of extending side portions 76 and 78 for receiving the mounting screws 80 and 82. Again, the posts 22–30 interact with the front plate 74 or the forward portion 75 of the valve, or both, to prevent the switch 10 from substantially rotating when the control shaft 84 is rotated. The extending side portions 76 and 78 of the Schoenberger valve, it is noted, are located below the center of the shaft 84 and not in line with it as are side extensions 64, 68 of the Robert Shaw valve of FIGS. 6, 7. Nevertheless, the posts 22–30 will engage the front panel 74 and the forward extending portion 75 sufficiently to hold the switch 10 from rotating on the valve.

FIG. 10 shows a second type of a Harper Wyman valve which has a generally circularly-shaped front plate 88 and a pair of extending side portions 90 and 92 which receive the mounting screws 94 and 96. The front plate 88 of the Harper Wyman valve shown in FIG. 10 must be slightly modified from its present commercially available configuration by forming four rounded fillets 89 in the front plate 88 to accommodate the posts 22–30. The electrical switch 10 is again mounted so that the posts 22–30 engage the front plate 88 or the forward portion 98, or both, in a manner which prevents the electrical switch from rotating when the control shaft 100 is rotated.

It is seen from FIGS. 1–14 of the drawings that it is not absolutely necessary to employ all four posts 22–30 on the switch 10 with the illustrated types of valves since only one pair of posts is actually required but both pairs of posts are preferred for greater security. In order to complete the assembly, it is necessary to insure that the switch 10 does not move along a control shaft, such as the shaft 104 of FIG. 12, sufficiently to disengage the posts 22–30 from the valve. In order to insure this, a number of methods may be employed, three of which are illustrated in FIGS. 12 through 14.

In FIG. 12 the switch 10 is prevented from sliding along the shaft 104 by means of a resilient washer 106 which is inserted on the shaft 104 between the body of the switch 10 and a panel 102 of the appliance. A control knob 108 is secured on the outward end of the shaft 104.

In FIG. 13 the switch 10 is slipped onto the shaft 110 and is limited from moving excessively along the shaft 110 by means of the control knob 112 which passes through an aperture 114 in the panel 116 so that the extending portion 118 limits the movement of the switch 10. It is to be noted that the assembly of FIG. 13 does not require the panel 116 to be present and thus, along with the posts 22–30, the knob 112 provides a way of securing the switch on a gas valve which may be used where panels are not present.

In FIG. 14 the switch 10 itself may be formed with an extension post 120 which extends in a direction opposite to that of the posts 22–30 and which is positioned so that it engages the panel 122 to limit movement of the switch 10 on the control shaft 13. The control shaft 123 for the valve extends through an aperture 124 in the panel 122.

Because of its unique construction, the electrical switch of the present invention may also be used for applications other than as a gas ignition switch. Thus, the cost of the switch for electrical ignition units might thereby further be reduced because of the possible wider applications of the switch. This broader use may be achieved by providing the posts 22–30 with threads so that they could alternately be inserted through apertures in a panel and then mounted to the panel by threaded nuts. In addition, apertures, such as the apertures 128 and 130, may be provided in the switch so that mounting bolts could pass through these apertures in order to hold the switch in place against a panel or bracket.

An additional way in which the switch 10 may be retained on the shaft of a gas valve would be to provide a knurled portion on the shaft which would thereby retain the cam 16 which in turn retains the housing 12 of the switch 10 and prevent it from sliding along the shaft.

A second version of the switch of the present invention is illustrated in FIGS. 15–21 wherein the switch 10' has a housing 12' which has a slightly different configuration than the housing 12 of the switch 10, the main difference being that the housing 12' is slightly larger than the housing 12. This allows for the posts 22', 28' and 30' to be formed in the interior portion of the housing 12' instead of near the edge of the housing, as were the posts of the switch 10. The switch 10', except for the external configuration of the housing 12' and the fact that it utilizes three posts instead of four posts, may be identical to the switch 10 of FIG. 1. Thus, the switch 10' has a central aperture 14' into which a rotatable operating member 16' is inserted. The rotatable operating member 16' has a central aperture 18' and a flat surface 17' on it which imparts a D shape to the aperture 18'. The shape of the aperture corresponds to the shape of the valve shaft which fits through the aperture 18'. When the shaft of the gas valve is rotated the operating member 16' rotates and operates the contacts (not shown) of the switch 10'.

Figure 17:
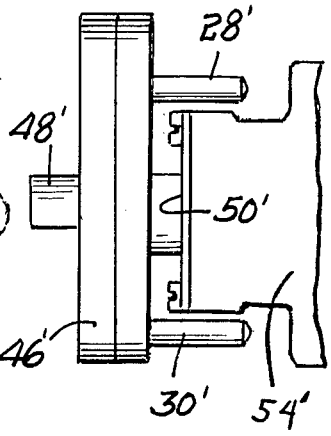
FIG. 17 is a side view showing the switch of FIG. 15 and a portion of the valve of FIG. 16.

The posts 22', 28' and 30' are preferably molded into the housing member 12' so that they extend outwardly at substantially normally with respect to the housing 12'. The distance between the posts 22' and 28' is substantially identical to the distance between the posts 22 and 28 of the switch of FIG. 1. Likewise, the distance between the posts 28' and 30' is substantially identical to the distance between the posts 28 and 30 of the switch of FIG. 1. The posts 28' and 30' are positioned so that the angle A' between the radial lines 42' and 44', which run from the center 36' of the aperture 18' and which pass approximately through the centers of the posts 28' and 30', respectively, equals approximately 135°. The chordal length between the posts 28' and 30' along the line 40' is approximately one and one-quarter inch. A third post 22' is also preferably employed which is located so that the angle C' between the radial lines 32' and 42' is approximately equal to 45°. The posts 22', 28' and 30' have a length which preferably is several times longer than the width of the switch housing across the side 46' of the housing 12', as shown in FIG. 17. The distance between the post 22' and the post 28' is approximately one-half inch along the line 41', and the posts 22', 28' and 30' are substantially equidistant along the radial lines 32', 42' and 44' from the center 36'.

Figure 16:
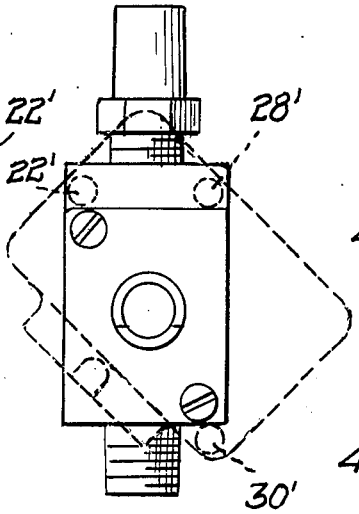
FIG. 16 is a front view of a Roberts Brass gas valve with the switch of FIG. 15 being shown on the valve by a dotted line representation.

FIGS. 16–21 show the switch 10' as it is mounted on the same gas valves that are illustrated in FIGS. 2–11. The posts 22', 28' and 30' are all positioned on the respective gas valves shown in FIGS. 16–21 so that they are at the same relative locations with respect to the gas valves as are the corresponding posts of the switch 10 of FIG. 1. For example, as shown in FIGS. 16 and 17, the post 22' occupies the position that the post 22 of the switch 10 occupied in FIGS. 2 and 3, while the post 28' occupies the same position that the post 28 did in FIGS. 2 and 3. Thus, the switch 10' is prevented from rotating on the shaft 48' by the interaction of these posts with the front panel 50' or the forward extending projection 54' on the valve, or both.

Figure 18:
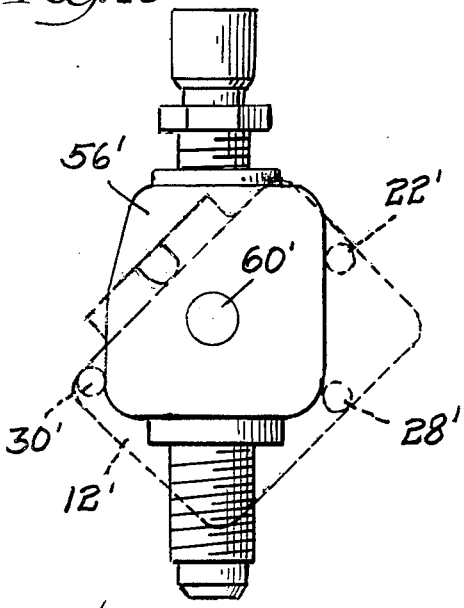
FIG. 18 is a front view showing one type of a Harper Wyman gas valve with the electrical switch of FIG. 15 being shown by a dotted line representation.

The switch 10' of the present invention is shown in FIG. 18 on the Harper Wyman valve in which the front plate 56' is of a non-uniform shape. Again, the posts 22'–30' interact with the front plate 56' of the valve, or the forward portion of the valve (not shown), or both, to prevent the switch housing 12' from turning when the control shaft 60' is rotated.

Figure 19:
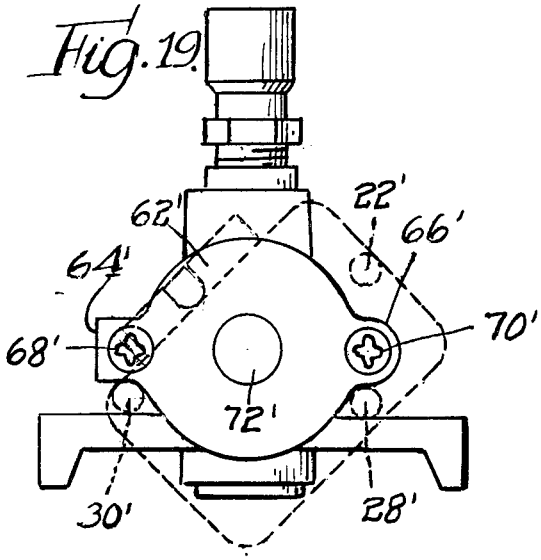
FIG. 19 is a front view of a Robert Shaw gas valve with the electrical switch of FIG. 15 being shown by a dotted line representation.

FIG. 19 shows a Robert Shaw type of valve in which the front plate 62' is of a generally circular shape which has two projecting end portions 64' and 66' which receive the mounting screws 68', 70' therein. Again, the posts 22'–30' interact with the front plate 62' of the valve, or the forward portion of the valve (not shown) or both, to prevent the switch from rotating when the shaft 72' is rotated.

Figure 20:
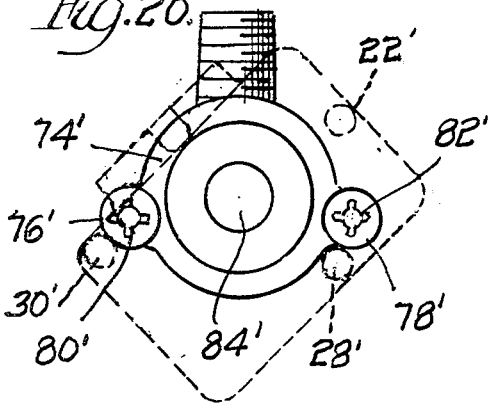
FIG. 20 is a front view of a Schoenberger gas valve which shows the electrical switch of FIG. 15 by a dotted line representation.

FIG. 20 shows a Schoenberger type of valve which has a generally circularly shaped front plate 74' and a pair of extending side portions 76' and 78' for receiving the mounting screws 80' and 82'. Again, the posts 22'–30' interact with the front plate 74' of the valve, or the forward portion of the valve (not shown), or both, to prevent the switch 10' from substantially rotating when the control shaft 84' is rotated. The extending side portions 76' and 78' of the Schoenberger valve are located below the center of the shaft 84' and not in line with it as are the side extensions 64' and 66' of the Robert Shaw valve of FIG. 19.

Figure 21:
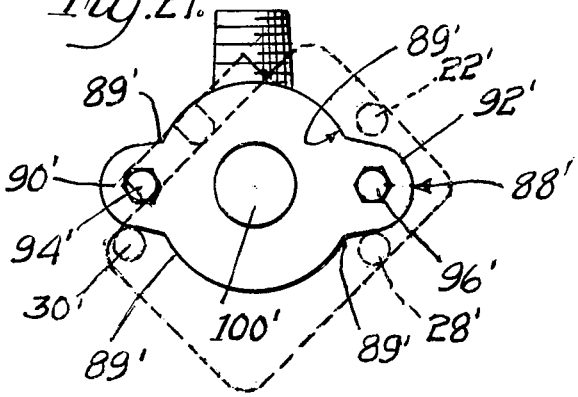
FIG. 21 is a front view which shows a second type of Harper Wyman gas valve with the electrical switch of FIG. 15 being shown by a dotted line representation.

FIG. 21 shows a second type of the Harper Wyman valve which has a generally circular shaped plate 88' and a pair of mounting screws 94' and 96'. The front plate 88' of the Harper Wyman valve shown in FIG. 21 must be slightly modified from its present commercially available configuration by forming four rounded fillets 89' in the front plate 88' to accommodate the posts 22'–30'. The electrical switch 10' is again mounted so that the posts 22'–30' engage the front plate 88' or the forward portion of the valve (not shown), or both, in a manner which prevents the electrical switch from rotating when the control shaft 100' is rotated.

What is claimed is:

1. In an electrical switch assembly including a housing having an outside surface and an aperture therethrough and an operating member rotatably mounted in said aperture of said housing for receiving a control shaft the improvement comprising a pair of mounting posts of electrically insulating material that extend in a substantially normal direction from said outside surface of said housing with said posts of said pair of posts being positioned substantially equidistant from the center of the said aperture along first and second radial lines, each of which pass substantially through the center of one of said posts and the center of said aperture wherein said radial lines make an angle of approximately 135° therebetween the chordal length of a line running between the posts of each pair of posts is approximately one and one-quarter inches.

2. The improvement as claimed in claim 1 wherein said improvement further comprises a second pair of mounting posts of electrically insulating material that extend from said housing such that each of said four posts is positioned at one corner of an imaginary rectangle with one post of each pair of posts being separated from the closest post of the other pair of posts by a distance of approximately one-half inch.

3. The improvement as claimed in claim 1 wherein said improvement further comprises a third mounting post of electrically insulating material that extends from said housing such that said third post is separated from one of said posts of said pair of posts by a distance of approximately one-half inch along a line running substantially normal to a line running between said posts of said pair of posts.

4. In a gas valve and electrical ignition switch combination including a gas valve having a front panel thereon, a forwardly extending portion and a control shaft projecting therefrom, and an electrical switch assembly including a housing having an outside surface and an aperture therethrough, and an operating member rotatably mounted in said aperture of said housing for receiving said control shaft, the improvement comprising a pair of mounting posts of electrically insulating material that extend in a substantially normal direction from said outside surface of said housing in a direction substantially parallel to said control shaft and into engagement with said front panel or said forwardly extending portion, or both, of said gas valve so as to prevent said switch assembly from rotating to any substantial extent when said control shaft is rotated, said posts of said pair of posts being positioned substantially equidistant from the center of said aperture along first and second radial lines, each of which pass substantially through the center of one of said posts and the center of said aperture and means for limiting the movement of said switch housing along said control shaft to prevent disengagement of said posts from said valve wherein said radial lines make an angle of approximately 135° therebetween and the chordal length of a line running between the posts of each pair of posts is approximately one and one-quarter inches.

5. The improvement as claimed in claim 4 wherein said improvement further comprises a second pair of mounting posts of electrically insulating material that extend from said housing such that each of said four posts is positioned at one corner of an imaginery rectangle with one post of each pair of posts being separated from the closest post of the other pair of posts by a distance of approximately one-half inch.

6. In a gas valve and electrical ignition switch combination, wherein said switch includes a housing having an outside surface, the improvement comprising a pair of mounting posts and a third mounting post of electrically insulating material that extend from said outside surface of said housing such that the two posts of said pair of posts are substantially equidistant from the center of said aperture, and are positioned along radial lines that make an angle of approximately 135° therebetween, the chordal length of a line running between said posts of said pair of posts is approximately one and one-quarter inches and said third post is separated from one of said posts of said pair of posts by a distance of approximately one-half inch along a line running substantially normal to a line running between said posts of said pair of posts.

* * * * *